US011452890B2

(12) United States Patent
Caycedo

(10) Patent No.: US 11,452,890 B2
(45) Date of Patent: Sep. 27, 2022

(54) RAPIDLY DEPLOYABLE, COUGH AND SNEEZE, AEROSOL CONTAINMENT APPARATUS

(71) Applicant: Claudio H. Caycedo, Lubbock, TX (US)

(72) Inventor: Claudio H. Caycedo, Lubbock, TX (US)

( * ) Notice: Subject to any disclaimer, the term of this patent is extended or adjusted under 35 U.S.C. 154(b) by 0 days.

(21) Appl. No.: 17/226,068

(22) Filed: Apr. 8, 2021

(65) Prior Publication Data

US 2021/0316164 A1 Oct. 14, 2021

Related U.S. Application Data

(60) Provisional application No. 63/049,008, filed on Jul. 7, 2020, provisional application No. 63/007,113, filed on Apr. 8, 2020.

(51) Int. Cl.

| | |
|---|---|
| ***A62B 18/02*** | (2006.01) |
| ***A62B 18/08*** | (2006.01) |
| ***A62B 23/02*** | (2006.01) |

(52) U.S. Cl.

CPC ..... *A62B 18/025* (2013.01); *A62B 18/084* (2013.01); *A62B 23/025* (2013.01)

(58) Field of Classification Search

CPC ..... A62B 18/025; A62B 18/02; A62B 18/084; A62B 18/08; A62B 23/00; A62B 23/02; A62B 23/025; A62B 7/00; A62B 7/10; A62B 9/04; A62B 9/02; A62B 25/00; A62B 25/005; A61M 16/06; A61M 16/0605; A61M 16/0611; A61M 16/0616; A61M 16/0622; A61M 16/0683; A61M 16/0688; A41D 13/11; A41D 13/1107;

(Continued)

(56) References Cited

U.S. PATENT DOCUMENTS

| | | | |
|---|---|---|---|
| 6,338,342 | B1 | 1/2002 | Fecteau et al. |
| 8,375,949 | B2 | 2/2013 | Shim |

(Continued)

FOREIGN PATENT DOCUMENTS

| | | | |
|---|---|---|---|
| CN | 103446683 | B | 8/2016 |
| DE | 202020001511 | U1 | 5/2020 |

(Continued)

OTHER PUBLICATIONS

Harry Kim, International Search Report and Written Opinion, dated Jul. 23, 2021, for corresponding PCT application PCT/US2021/026491, ISA/US, Alexandria, VA, pp. 1-9.

(Continued)

*Primary Examiner* — Joseph D. Boecker
*Assistant Examiner* — Brian T Khong
(74) *Attorney, Agent, or Firm* — G. Michael Roebuck; Moster Craft, P.C.

(57) ABSTRACT

A rapidly deployable, pressure sealed, cough and sneeze aerosol, containment apparatus and a system to virtually eradicate the cold, the flu, and Covid-19. A face mask having a rigid first section configured to hold a filter and a pliable second section configured to fit on a person's face; a face mask seal formed on an edge of the pliable second section of the face mask; a curved surface on the face mask seal configured to fold inward to form a seal on the person's face when pressed on the person's face.

15 Claims, 17 Drawing Sheets

(58) Field of Classification Search
CPC ..... A41D 13/1138; A41D 13/1146; A41D 13/1161; A41D 13/1169; A41D 13/1176; A41D 13/1192
See application file for complete search history.

(56) References Cited

U.S. PATENT DOCUMENTS

| | | | | |
|---|---|---|---|---|
| 8,590,532 | B2 | 11/2013 | Forbes et al. | |
| 9,357,805 | B2 | 6/2016 | Wright | |
| 9,468,782 | B2 | 10/2016 | Koehler | |
| 2006/0154591 | A1 | 11/2006 | Marx | |
| 2012/0260920 | A1* | 10/2012 | Choi | A62B 18/025 128/206.12 |
| 2014/0182592 | A1 | 7/2014 | Aharoni | |
| 2015/0336718 | A1 | 11/2015 | Dwyer et al. | |
| 2018/0035773 | A1* | 2/2018 | Wiegand-Hansen | A45F 5/021 |
| 2018/0353783 | A1 | 12/2018 | Dwyer et al. | |
| 2021/0353798 | A1* | 11/2021 | Spear | A45C 15/00 |
| 2021/0401157 | A1* | 12/2021 | Scalisi | A45C 11/00 |
| 2021/0402230 | A1* | 12/2021 | Caycedo | B01D 46/0004 |

FOREIGN PATENT DOCUMENTS

| | | | |
|---|---|---|---|
| JP | 2005000613 | A | 1/2005 |
| JP | 2011000430 | A | 1/2011 |
| KR | 200188195 | Y1 | 7/2000 |
| KR | 102030473 | B1 | 10/2019 |
| WO | WO2012003565 | A1 | 1/2012 |
| WO | WO2020/028407 | | 2/2020 |

OTHER PUBLICATIONS

Harry Kim, International Search Report and Written Opinion, dated Sep. 27, 2021, for corresponding PCT application PCT/US2021/36267, ISA/US, Alexandria, VA, pp. 1-8.

* cited by examiner

RAPIDLY DEPLOYABLE, COUGH AND SNEEZE, AEROSOL CONTAINMENT APPARATUS

CROSS REFERENCE TO RELATED APPLICATIONS

This patent application is based on, and takes priority from, U.S. Provisional Patent Application Ser. No. 63/00,713 filed on Apr. 8, 2020 and entitled "A Rapid Deployable Pressure Relief Biological Hazard Mask" by Caycedo and U.S. Provisional Patent Application Ser. No. 63/049,008 filed on Jul. 7, 2020 and entitled "A Rapid Deployable, Pressure Sealed, Cough Aerosol Containment, COVID-19, Cold, and Flu Eradication Mask" by Caycedo, both of which are incorporated by reference herein in their entirety.

BACKGROUND OF THE INVENTION

There is a need for a hygienic device that is specifically designed and built to capture sufficient virus laden respiratory droplets and aerosols, produced during coughs and sneezes, so as to virtually eliminate the possibility of causing respiratory infections such as COVID-19, the cold, and flu in those nearby.

FIELD OF THE INVENTION

The present invention is involved with biologically protective devices. It may be the first device of its kind that is specifically designed, built, and mass marketed to protect others, as opposed to protecting the user of the device. This device is part of a system to help stop the COVID-19 pandemic.

SUMMARY OF THE INVENTION

A rapidly deployable, pressure sealed, cough and sneeze aerosol, containment apparatus and a system to virtually eradicate the cold, the flu, and Covid-19.

DETAILED DESCRIPTION OF THE INVENTION

Figure 1:
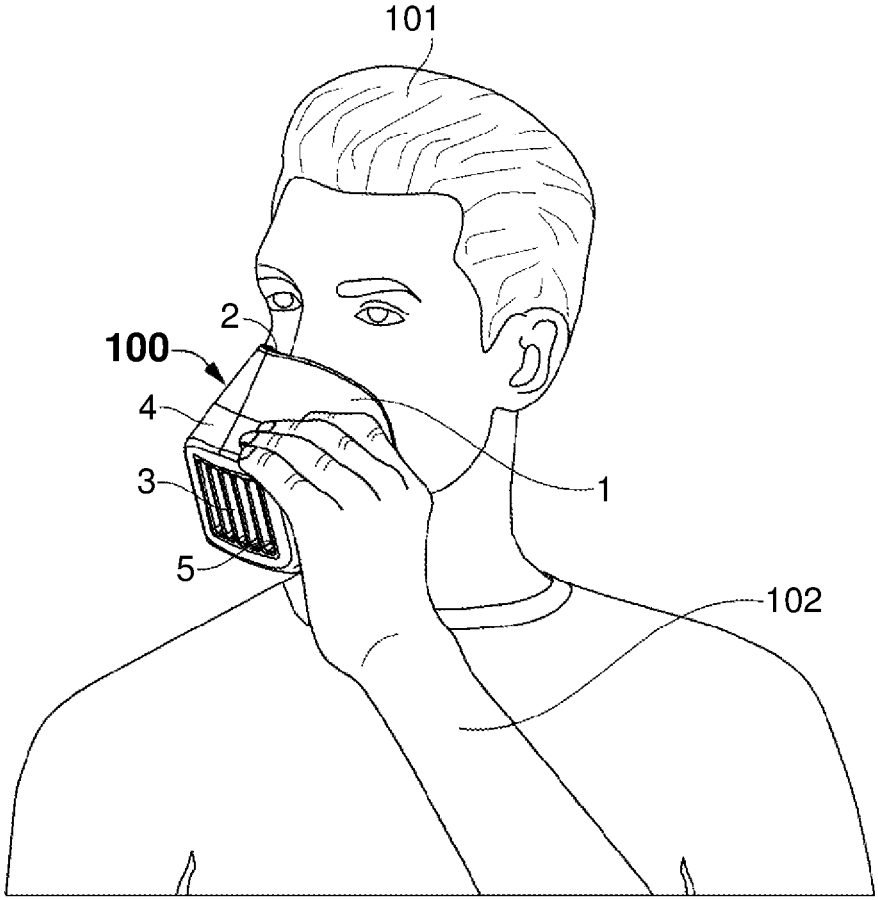
FIG. 1 is a front three quarter perspective view depiction of a device apparatus in a particular illustrative embodiment of the present invention.

An illustrative embodiment of a system and method and apparatus for a rapidly deployable cough and sneeze particle containment apparatus (also referred to herein as "Covid Cough Cleanser, CCC or mask") is disclosed herein. In a particular illustrative embodiment of the invention, a face mask and mask holder. The recent COVID-19 pandemic has exacerbated and magnified the need for public protection equipment (PPE) to protect the public from airborne viruses such as SARS-CoV-2. Although the CDC recommends mask use for the protection of other, the prior masks were not specifically designed for that purpose. The paradigm shift here is the current invention is specifically designed for the protection of others.

In the past, the mask deployment has been has been for self-protection, to keep from being infected by others who spray infected mucous and salivary particles in the air, this new Covid Cough Cleanser substantially eliminates the general release of infectious mucous and salivary particles into the air, the new paradigm using the Covid Cough Cleanser Mask is to protect others and stop the release of infectious mucous particles into the air and therefore more efficiently and effectively reduce and eliminate the spread of infectious respiratory diseases such as COVID-19, the common cold, and flu.

In the past, with a typical mask, when a person wearing the mask sneezes or coughs, the sudden pressure on the inside of the mask created by the air and mucous particles being expelled by the wearer, lifts the typical mask off the face at the edges to allow aerosols to escape, and allowing the infectious mucous particles to spread into the air and cause infections.

The Covid Cough Cleanser Mask exerts more pressure on the edges of the mask so that the sudden pressure of the sneeze does not lift the edges of the Covid Cough Cleanser Mask so that infectious mucous particles are not released from the sides of the Covid Cough Cleanser Mask and are instead forced through a high flow rate filter that filters and substantially retains the mucous particles while releasing the filtered cough and sneezed air only through the filter.

The Covid Cough Cleanser is conveniently holstered on a wearer's belt and ready to be deployed at a moment's notice when needed. A wearer removes the CCC from the holster, raises it to their face, and presses the CCC against the face using their hand with sufficient pressure to create a pressure seal between the Covid Cough Cleanser and the wearer's face. In a particular illustrative embodiment, a surgical mask is altered to create the Covid Cough Cleanser. The filter is held in place inside the mask and air passes from the wearer's mouth or nose and exists the mask through a filtered hole in the Covid Cough Cleanser. The mask hole is large enough to allow the sneezed air to exit the mask rapidly after passing through the filter. In another particular embodiment, a grill is provided to protect the external surface of the filter. The filter reduces the concentration of infectious droplet and aerosol particles (also referred to herein as just "aerosols") that are released into the air by COVID-19 carriers, thus reducing the spread of the SARS-COV-2 virus. Once the basic reproductive number, within an active zone, falls below 1.0 the pandemic in that zone will die off.

In another particular embodiment, the Covid Cough Cleanser is custom fitted to a wearer's face so that less pressure is required to seal the mask to the wearer's face. The size of the exhaust hole (or "hole") in the mask determines the flow rate of the air out of the filter. A larger hole allows the air to escape the mask easier. In another particular embodiment, a CPR mask is altered to create the Covid Cough Cleanser. The custom fitted mask does not use a CPR mask to create the CCC but instead creates the CCC, as molded custom soft rubber or other pliable material custom fitted to a wearer's face.

In a particular illustrative embodiment of the invention, all activities outside of homes in an active region will substantially return to normal when everyone in that region carries and uses a particular illustrative embodiment of the invention, referred to herein as a "Covid Cough Cleanser". (Herein cough will also imply sneeze.) Those who cannot reliably use the Covid Cough Cleanser, the young, etc., will remain quarantined until all residual cases are resolved, and the region is COVID-19 free.

The Covid Cough Cleanser is substantially better at catching cough aerosols compared to what is in common use today . . . the tissue, commonly referred to as a Facial tissue, KLEENEX®, the inside of the elbow, and a surgical mask. The problem with the tissue, elbow and surgical mask is that particles from a cough or sneezed are allowed to escape due to the rapid pressure increase encountered when a person sneezes or coughs into a tissue, elbow, or surgical mask. A tissue or elbow fails to capture all of the particles from a cough or sneeze. A surgical mask lifts off the face during a cough or sneeze allowing particles to escape from the mask along the edge of the mask instead of passing through a filter so that the particles are captured in the filter and do not escape to risk infecting another person.

In a particular illustrative embodiment of the filter, the Covid Cough Cleanser is specifically designed to fully trap virtually all cough aerosols that may contain virus particles. The Covid Cough Cleanser is made of low cost materials similar to a CPR mask but with a high flow rate aerosol filter. As with a CPR mask, firm hand pressure creates a very tight air seal between the mask and the wearer's face and there are no attachment straps on the CCC. In a particular illustrative embodiment, the Covid Cough Cleanser is carried in-hand while squeezing into tight spaces such as the middle seat of an airplane or in a side "holster" attached to a dress belt. Both allow for a "quick draw" to catch any cough aerosols. In a case wherein another's nearby cough is not covered by a CCC, it just turns out the Covid Cough Cleanser Mask can double as a highly effective emergency personal protective breathing mask to be used until one can safely leave the immediate area or preferably, go outdoors It is important to note that such emergency use was not a design criterion, but rather that it just worked out that way, after the design was complete, by sheer coincidence. In order to optimize efficacy and efficiency, the one and only design criteria of the CCC was to create the most effective and efficient Covid-19 cough cleanser humanly possible given current technology. Also, by sheer coincidence, the CCC is effective against other respiratory diseases including, but not limited to, the common cold and flu. Please note that also by coincidence, the CCC System is not affected in any way, shape, or form, by mutations or variants of COVID-19. (By contrast, these mutations and variants are the Achilles heel of all COVID-19 vaccines). In fact, also by coincidence, the CCC System will be 100% effective against any future coronavirus pandemics that may arise from the region around Wuhan, China.

Universal compliance within an active region is important. (An active region is a region where universal use of the CCC is mandatory either by law or by mutual agreement.) Luckily, Covid Cough Cleanser compliance comes easy and naturally. Daily wear will be like wearing a clothing accessory . . . that everyone else is also wearing. Actual deployment and use of the Covid Cough Cleanser is typically rare and lasts only seconds! (Anyone repeatedly coughing should be quarantined.) The Covid Cough Cleanser will be as natural to use as a Handkerchief. My father never left his house without a clean handkerchief peeking out of his back pocket. Nowadays, we naturally look for a Facial tissue, KLEENEX® before coughing (but the Facial tissue, KLEENEX® box is rarely nearby). Life immediately returning back to normal is a great motivator for everyone to comply with the simple Covid Cough Cleanser System!

In a particular illustrative embodiment, substantially everyone in a region will receive a Covid Cough Cleanser before distribution moves to another region. Universal compliance is thereby substantially achieved region by region (as quickly as masks are manufactured.) Active regions will be "closed" meaning visitors to the region or travelers "just passing thru" the region must have a Covid Cough Cleanser to enter the region.

With such universal distribution and compliance within a region, the local basic reproductive rate in that region will suddenly drop to nearly zero bringing a quick end to the COVID-19 epidemic in that region. This can be safely, easily, quickly, and inexpensively tested and verified in a small town, a cruise or military ship, a military base, a nursing home, or any other controlled access region. For the re-assurance of everyone, the CCC can first be safely tested as an adjunct to any currently existing COVID-19 protocols such as social distancing, masking, etc. When the reliability of the CCC System to predictably, immediately, and dramatically stop virtually all new infections in any given region is firmly established, the CCC System can then be safely tested without any other COVID-19 protocols in place. At this point, there will be an all-out race to deliver the CCC System throughout the world.

In a particular illustrative embodiment of the invention (also referred to herein as a "Covid Cough Cleanser") a filter holder is removable from the back (or inside) of the mask.

This allows cough and sneeze pressures to produce a seating pressure on the filter holder instead of a dislodging pressure as would be the case if the filter holder were removable from the front of the CCC. This will help maintain a tight pressure seal between filter holder and mask.

In a particular illustrative embodiment of the invention a new apparatus for virus capture is disclosed. Masks designed to capture virus sometimes make it a goal to capture the virus directly. In particular, care is taken to make sure the filter used is capable of capturing particles as small as the virus in question. This can sometimes lead to a highly restrictive filter that produces a high pressure drop that in turn lifts an apparatus off the face promoting leakage and infection; This is particularly inadequate in the application of filtering high velocity coughs and sneezes. In the design of the CCC it is specifically recognized that when we cough or sneeze viruses are not free floating but are generally well adhered to, or trapped inside, cough and sneeze aerosol particles. It is the strategy of the CCC method, instead, to target these larger, heavier, virus "vessels" . . . Catch the aerosol, catch the virus.

Generally, the filtration mechanics available are gravity sedimentation, inertial impaction, interception, diffusion, and electrostatic attraction. Of these, inertial impaction methods are directly more efficient the heavier the target object is. Furthermore, inertial impaction methods can be quadratically more efficient the faster an object moves. What is more, inertial impaction methods are less restrictive, or have a lower pressure drop, than other methods like say the interception method; This is particularly important in our goal of filtering high velocity coughs and sneezes. In summary, inertial impaction methods are effective at capturing heavier and faster moving particles while maintaining a lower pressure drop across the filter and therefore are particularly well suited for the CCC. As an adjunct mechanism, electrostatic attraction can safely be added without jeopardizing a low pressure drop.

In a particular illustrative embodiment of the invention, a high flow rate filter is provided from Zoro manufacturing at zoro.com with the following product number and specifications.

Filter example. Air Handler #2GJH2 Specifications

Zoro #: G7514981 Mfr #: 2GJH2 available from Zoro at zoro.com

Specifications: filter Air Filter Roll, Style—Air Filters Roll, Nominal Filter Size 8 in ×90 ft×1 in, Performance Rating MERV 8, Filter Efficiency—Air Filters 60 Percent, Common Applications General Use, Media Material Polyester, Surface Tackifier Yes, Media Color Orange/White, Filters Out Cat & Dog Dander, Cement Dust, Dust Mites, Dusting Aids, Fabric Protector. Hair Spray, MERV 5-8 Mold, Pudding Mix, Spores, Removes Particles Down To 3.0 to 10.0 microns, Initial Resistance @ 3K) fpm 0.19 in wc.

Other similar filters can be used in another particular illustrative embodiment of the invention.

In a particular illustrative embodiment of the invention, a Longer Filter replacement cycle is a goal of, and is achieved by, the CCC.

a) Typical fine, virus filters have a problem with clogging. Fine filters tend to get clogged quicker and need to be replaced more frequently. This is especially true when larger sputum particles could be in the mix, as is sometimes observed in cough or sneeze applications. Courser aerosol filters are more porous and therefore last longer, particularly so in this application.

b) Humidity. Prior face masks and other filters tend to degrade with the moisture in our breath.

This is especially important with coughs and sneezes that can be quite moist at times.

Nonabsorbent, fibrous fiber, aerosol filters degrade less with moisture and therefore last longer.

c) Rinsible under tap water. Fine filters designed to catch viruses tend to be non-washable. CCC aerosol filters are rinsible under ordinary tap water.

d) Re-usable. Virus capturing filters tend to be disposable and therefore tend to have high, long-term, operating expenses. CCC aerosol filters are re-usable and will last six to twelve months, depending on use.

The CCC is designed to be used, from here on out, by everyone on earth; therefore, total life-cycle costs are a high design consideration. In a particular illustrative embodiment of the invention a Re-useable Filter Holder is provided. Only the raw, cut filter stock is replaceable, thereby lowering total life cycle costs.

In a particular illustrative embodiment of the invention, inexpensive, yet long-term durable materials are chosen. Aside from the filter, all other CCC materials are durable long-term and should last for years. This will further reduce total life-cycle costs and increase convenience.

The world is currently facing a protective gear material shortage. The CCC addresses this issue by choosing durable materials and reusable filters. Also, aerosol filters are currently in abundant supply. Furthermore, by definitively stopping the COVID-19 pandemic, material shortages should improve.

In a particular illustrative embodiment of the invention a filter holder is accessed from the back of the apparatus instead of from the front of the apparatus. This design feature ensures that hard sneezes do not tend to separate the filter holder from the apparatus but instead bring them together tighter.

In a particular illustrative embodiment of the invention Filter Holder Fasteners are provided. The filter holder fasteners hold the filter holder firmly against the body of the CCC. This helps create a good pressure seal between the filter holder and the CCC body.

In a particular illustrative embodiment of the invention a Filter Holder Screen is provided. The filter holder access panel doubles as a filter screen. This screen helps hold the filter in place, protects the filter from physical damage, and screens out larger sputum particles that may be expelled during a cough or sneeze, thereby helping to keep the filter clean.

In a particular illustrative embodiment of the invention, wide grill spacing is provided. The wide grill space allows high velocity air flows generated by coughs and sneezes to flow freely, with less aerodynamic friction; The grill also holds the filter in place and protects it from external physical damage.

In a particular illustrative embodiment of the invention a large filter cross-sectional area is provided. The cross-sectional area of the filter is intentionally made larger to accommodate cough and sneeze high flow rates with less aerodynamic drag and lower pressure drops across the filter.

In a particular illustrative embodiment of the invention a thick filter is provided. The filter is intentionally made thicker as a redundant safety feature. In a particular illustrative embodiment of the invention a one-inch-thick filter is provided instead of a half-inch-thick filter.

In a particular illustrative embodiment of the invention, a folded back rubber seal is provided. It is specifically recognized that this is the reverse, or an inversion of, a scuba diving mask seal design. In a scuba mask the seal edges point outward and the positive pressure is outside the mask.

In the CCC design the seal edges point inward and the positive pressures generated are inside the apparatus. This makes for a tight, internal positive pressure, seal design . . . perfect for this application of covering coughs and sneezes.

In a particular illustrative embodiment of the invention a Rubber Seal is provided. The Rubber Seal is contoured to exactly match generic, or averaged, face contours of different sizes and shapes.

In a particular illustrative embodiment of the invention the Rubber Seal provides softness and is pliable enough to conform to individual facial thereby maintain a positive pressure seal.

In a particular illustrative embodiment of the invention, an Inexpensive injection molded plastic design is provided. The Body of the CCC and the filter holder are made of inexpensive injection molded plastic.

In a particular illustrative embodiment of the invention, the CCC is designed to be more usable with eyeglasses. The CCC does not extend into areas near, or around, the bridge of the nose. This feature makes the CCC more easily used by people who wear vision corrective glasses or sunglasses.

In a particular illustrative embodiment of the invention, no permanent straps are provided nor needed. This design feature recognizes that when quickly deploying the CCC, straps could swing between the face and seal, causing a potential compromise of the pressure seal. Therefore, no permanent straps are present. The CCC is held in hand and firm hand pressure against the face creates a positive pressure seal with the face. (A positive pressure across the seal is hereby defined as air pressure inside the apparatus being higher than the external, ambient air pressure.) In a particular illustrative embodiment of the invention, a CCC Belt Holder is provided. At the heart of the Covid Cough Cleanser is a continuously convenient, quickly accessible, CCC Belt Holder. This is an essential part of the plan of having the CCC with you at all times while in public places . . . while also being very convenient to access at a moment's notice. In certain crowded situations, such as while seating in the middle seat of an airplane, the CCC may be held in hand or on one's lap. Care must be taken, if the CCC is carried on a lanyard, to prevent the lanyard from being accidentally placed between the face and CCC during quick deployments and thereby potentially compromising the pressure seal. . . . A lanyard that is easily detachable by a quick yank on the CCC is specifically envisioned.

In a particular illustrative embodiment of the invention, a CCC hygienic cover is provided.

Integral to the belt holder design is a cover that prevents access to potentially contaminated surfaces inside the CCC. This design feature helps to prevent indirect, or fomite, infections.

In a particular illustrative embodiment of the invention, mask holder arms are provided. The belt holder has two arms that hold the CCC in place when the CCC is docked with the belt holder.

In a particular illustrative embodiment of the invention, a toggle mechanism for the mask holder arms is provided. Upon docking the CCC into the belt holder, firmly pressing the CCC against the Belt Holder activates an integrally designed Toggle Switch that triggers the mask holder arms to clamp shut around the CCC and thereby maintain the CCC docked with the Belt Holder.

In a particular illustrative embodiment of the invention, a quick release design feature is provided. The CCC Holder Arms have CCC Holding Pads (or hands) with a ramp feature. As the CCC is pulled directly away from the Belt Holder, the ramp separates the CCC Holder Arms apart and thereby triggers the arm toggle mechanism to fully snap open the mask holder arms and thereby quickly releasing the CCC. The arms are held in this open position until the CCC docked again.

In a particular illustrative embodiment of the invention, a toggle mechanism is specifically designed to open and close both arms, simultaneously. This feature helps keep the CCC centered on the mask holder.

In a particular illustrative embodiment of the invention, left and right-hand use is facilitated.

Aligning the CCC upright on the belt holder allows for left/right symmetry so that the CCC belt holder can be donned on the left-hand side by left handers or on the right-hand side by right handers.

In a particular illustrative embodiment of the invention, the size of the CCC is a carefully chosen compromise between large enough to easily cough and sneeze into, large enough to accommodate a large filter, and yet small enough for ease of handling and portability.

The Covid Cough Cleanser and the face should be wiped down after each use. Therefore, part of the contemplated system is to also carry a small package of disinfectant wipes on a belt holder. This will allow the CCC to be held in one hand while a disinfectant wipe is conveniently accessed with the other hand . . . as opposed to rummaging thru a purse or a pocket for a wipe dispenser and then pulling a wipe with one hand while securing the wipe dispenser with the other hand.

In a particular illustrative embodiment of the invention, a Belt Holder Funnel is provided. A spreading angle on a CCC Hygienic Cover "Extension" provides funneling or guidance to docking the CCC with the Belt Holder. This makes it easier to align the CCC with the belt holder with less visual assistance. This design feature is especially helpful to younger children and the elderly.

In another particular illustrative embodiment of the invention, a Grip feature is provided. This design feature will allow easier grip of the CCC during deployment and docking.

In another particular illustrative embodiment of the invention, Temporary Straps are provided.

To be used for convenience when the CCC is to be used as a self-protective face mask for an extended period of time. (Useful only prior to the CCC going into universal use.)

System of Implementation to Immediately and Dramatically Stop COVID-19. It is specifically recognized by the CCC method that virtually all direct and indirect Covid-19 Infections arise from infected particles that are expelled by infected individuals during coughs and sneezes. It is further specifically recognized by the CCC method that although infected particles are expelled during normal speech and normal breathing, these activities cause virtually zero infections; It is further recognized that any assumption to the contrary is extremely dangerous because it tends to deviate the world from the correct approach to eradicating COVID-19. Specifically, the correct approach to eradicating COVID-19 is by using the CCC to cover all coughs and sneezes.

The preferred mask filter is encased in the filter holder. This allows the inside of the mask to be wiped down with a disinfectant wipe after each use without wetting the filter itself. The filter holder will feature a grill on the outside of the mask. This allows for protection of the filter, ease of airflow, and low cost. The filter holder will feature a plastic mess, on the inside of the mask, that will help catch larger mucous parts (to be wiped afterwards.) Mask filter holder should be removable from the inside of the mask. This allows sneeze pressure to produce a seating pressure on the filter holder instead of a dislodging pressure. This will help to keep a tight seal between filter holder and mask. Aerosol filter should have several layers. This will allow the outer layers to remain dry and more effective on the finer sneeze droplets while the inner layers trap the larger sneeze droplets. The aerosol filter will work better when dry due to greater surface tension of droplets adhering to filter and to greater wicking force.

The Mask should normally not have straps that might inadvertently get between the face and the mask and weaken the face/mask seal. The mask is normally held only by firm hand force against the face and only during a sneeze or a cough. The Mask may have (removable) straps for temporary use without hand pressure. However, long term light strap pressure may not provide as tight a seal as short term firm hand pressure. (long term firm strap pressure may not be tolerable.) Thus strap use may be ok for use as breathing mask but may not be as effective as a sneeze catcher. Furthermore, prolonged continuous use of mask may moisten the filters due to expiration humidity and reduce effectiveness. Mask should be light weight for ease of toting and deployment. CCC Mask can be used as breathing mask for short periods of time . . . as when someone next to you does not deploy their CCC Mask correctly or in time. CCC Mask should be constructed in enough sizes and shapes to fit and seal properly on most everyone. The mask should be distributed by folks trained to help choose the right fit. In special circumstances, a custom mask or a custom adapter could be made by taking a digital scan of a face (at a higher cost.)

In another particular illustrative embodiment of the invention Those with eyeglasses are provided with a version of the CCC where the nose bridge sits lower. The CCC mask should be made of material strong enough to withstand firm hand force pressing the mask against the face . . . as done so in normal use. The borders of the mask touching the face should be of soft material to allow for a good seal under normal use, possibly of soft rubber with one or more ridges, and/or with a balloon border. Air flow resistance thru the aerosol filter should be low enough so as to not cause pressure build-up inside the mask high enough to cause leakage of unfiltered air around the edges of the mask during normal use. The air flow resistance can be controlled thru material choice, density, thickness, number of filter layers, filter size (the larger the filter the lower the resistance) and location (directly in front of mouth/nose would be best.)

In another particular illustrative embodiment of the invention the CCC mask is carried in such a way so as to make for a quick deployment, such as but not limited to, a mask holder attached to the hip, a lanyard, a holder attached to the chest, and a holder attached to the forearm that places the mask near the hand.

In another particular illustrative embodiment of the invention, Design and Manufacture of production model should be optimized for quick production and low costs, so as to optimize for quick distribution to every human in America and possibly the world. The idea is to optimize the saving of lives everywhere.

According to the Centers for Disease Control (CDC) and the World Health Organization (WHO), COVID-19 is transmitted by respiratory droplets and aerosols (hereinafter aerosols) expelled when an infected person coughs or sneezes (hereinafter coughs). The virus is not free-floating but embedded in these respiratory aerosols. Therefore, if we completely contain these aerosols as they are exiting the mouth and nose, we will completely stop SARS-CoV-2 transmission. When everyone does this, the basic reproductive rate (R-0) will immediately plummet close to zero and new cases will practically cease to exist. Within months, life will essentially return back to normal: We will once again see full commercial flights, sold out concerts, and packed sporting events. Inadvertently, the flu and the common cold will also be stopped. What is more, we will have a completely effective shield in place against new coronavirus pandemics epidemiologists suggest will arrive soon.

Many believe stopping COVID-19 or the flu in this fashion is impossible, but in reality, we have never truly attempted it. As with any new mission, the first step is to design and build a new tool specifically to accomplish that task. It is believed that no one has ever designed, mass produced, and marketed a mask specifically for containing infectious cough aerosols.

Let us let this new tool be called the Covid Cough Cleanser Mask (CCC). To ensure its success, the CCC should be developed by a team of fluid dynamicists, aerodynamicists, mask engineers, filter scientists, microbiologists, and infectious disease specialists. This would be best accomplished by a joint effort between NASA and the CDC. To optimize effectiveness, the CCC will have only one design objective: to capture sufficient cough aerosols to eradicate any possibility of infection. The borders of the CCC will be made of soft rubber like that of a respirator mask, and when the CCC is firmly pressed against the face, an excellent positive pressure seal will be created. The bulk of the mask will be made of inexpensive hard plastic. The upper border will be sufficiently below the nose bridge to permit use with eyeglasses, and a removable filter holder will be located directly in front of the mouth and nose. Its fibrous aerosol filter will be washable, replaceable every six to twelve months of high efficiency, and will have a pressure drop well below the CCC's sealing capacity. An optional washable HEPA filter may be added downstream of the aerosol filter. The filter size will be approximately 2"×3"×1". Because the CCC is sealed with hand pressure and is only used for brief periods, no support straps are needed, nor are they desired, for they could accidently swing between the CCC and face, thereby potentially breaking a good pressure seal. The CCC may be conveniently toted in a carrier suspended by a dress belt; after clicking the CCC into the carrier, the inside of the CCC will become sealed. We do not need to develop any new science or technology; everything we need to design the CCC already exists. To avoid interruptions in production and distribution, the CCCs will be manufactured in domestic plants from domestic materials. The CCCs will be delivered door to door by a fleet of vans, and to ensure good CCC fit, trained delivery personnel will choose the right size and shape for each recipient. Recipients will briefly step outside their homes for this fitting. The complete cost of development, manufacture, custom fit, delivery to all US inhabitants, and project management will be about $5 billion: much less than the trillions of dollars the federal government has ineffectively spent on COVID-19. The slight inconvenience of carrying CCCs is not much different than that of carrying old-fashioned handkerchiefs.

This aerosol containment approach requires universal participation for effectiveness. Once CCCs begin rolling out of factories, it will take another year or so for the entire U.S. to be supplied. In the meantime, 100% participation may be achieved in smaller geographical zones—a county, city, or town, for example. All U.S. CCCs produced should be shipped to the hardest hit zone first, and when that zone is 100% supplied all deliveries would proceed to the next hardest hit zone, and so on. Once a zone is 100% supplied a start date would be designated for that zone. On this date, everyone in all public places would be required to properly carry and use the CCC, and check points would assure that no one entered the city without a CCC. Those who could not follow city code, like small children, would remain quarantined, but would be asked to use the CCC as best as possible, nonetheless. The number of new cases would dramatically drop to near zero immediately. A few new cases may arise in homes, hospitals, etc., but within a few months there will be no additional cases and all pre-existing cases will resolve shortly thereafter. At this point the zone will be declared COVID-19 free and all quarantines will be lifted. This process will be repeated until the entire nation is declared COVID-19 free. At this point all future masks produced will be donated to countries in need. A similar process will simultaneously take place in all countries until the world is declared COVID-19 free. Afterward, use of CCCs will continue indefinitely, worldwide to keep COVID-19, the cold, and flu at bay and to prevent any new pandemics.

This CCC aerosol containment approach miraculously solves many issues simultaneously: On day one of implementation, businesses may immediately and fully and reopen without social distancing, saving the U.S. economy trillions of dollars. On day one of implementation, the number of new cases will immediately plummet to near zero. Within a few months, that zone will become COVID-19 free. The cold and flu will be finally eradicated. No other approach can return life to normal. Quarantining the virus in a CCC is more effective and efficient than quarantining humans. We can avoid rushing vaccines without adequate trials. Similarly, we can avoid approving ineffective drugs without proper testing. Briefly covering coughs with a CCC is much more efficient and effective than continuously wearing a face mask. Because CCCs are easier to use, compliance will be vastly greater than observed with face masks. In the rare event of an unprotected cough, the CCC will double as an effective protective breathing mask, making the CCC aerosol containment approach fail-safe. Because CCCs capture contaminated aerosols before they land on surfaces, there will be no shortage of disinfectants and sanitizers. CCCs keep hands cleaner while covering coughs. By avoiding COVID-19 altogether, the aerosol containment approach will save the world from unprecedented levels of pain, suffering, and death. Furthermore, hospitals will once again be dedicated to other serious diseases. Perhaps most importantly, saving each other's lives with a CCC and placing our lives in each other's hands will inadvertently transform our world into a truly loving, and trusting, brotherhood of man.

Typically in the past, mask have been used to capture small particles like viruses with small pore filters. However, when we cough, or sneeze viruses are not generally free floating but are trapped inside aerosol particles. So, if we catch the aerosol, we indirectly catch the virus. Therefore, our approach is to catch cough and sneeze viruses with aerosol filters. (With an especially hard cough or sneeze some virus may break loose from that aerosol, but not enough to cause infection.) A problem we encounter when we capture small particles like viruses with small pore filters is a high pressure drop. This problem is made even worse when we filter high flow rates like those in coughs and sneezes because the pressure drop is proportional to the square of the air speed. High pressure drops are a problem because they tend to lift a mask off the face and cause leakage. A preferred filter is disclosed herein that is very porous and therefore has a very low pressure drop addressing the problem solved.

A preferred filter disclosed herein provides a longer filter replacement cycle. a) Clogged pores are a problem in prior masks. Small pore filters tend to get clogged quicker and need to be replaced more frequently. This is especially important with coughs and sneezes as larger sputum particles could be in the mix. A preferred filter is more porous and therefore solves this problem. Humidity is another problem with prior mask that is solved by a particular illustrative embodiment of the invention. Face masks and other filters tend to degrade with the moisture in our breath. This is especially important with coughs and sneezes as they can be quite moist at times. Aerosol filters degrade less with moisture and therefore improve the situation.

A preferred filter is rinsible under tap water. Face masks and other filters designed to catch viruses tend to be non-washable. Aerosol filters are rinsible under tap water.

A preferred filter is reusable. Most virus capturing filters are disposable which make them expensive to use. CCC filters are re-usable and, depending on use, will last six to twelve months when used as directed.

The preferred filters disclosed herein are less expensive than other fine pore virus capturing filters. The preferred filter holder disclosed herein is a reusable filter holder. Only the filter is replaced. raw, cut filter stock is replaceable. To save maintenance costs, the filter holder is re-usable. In a particular illustrative embodiment of the invention the apparats is made of Long-term durable materials. Aside from the filter, all other CCC materials are durable long-term and should last for years. This will further reduce costs and convenience. This is an important design feature given that once CCC use becomes universal, it is expected CCC use will remain forever.

Material Shortages. A common problem the world is facing is protective gear material shortages. The CCC will reduce the need for such short supply materials and aerosol filters are currently in abundant supply.

The filter holder is accessed from the back of the mask. This feature ensures that hard sneezes do not tend to separate the filter holder from the mask but instead bring them together tighter. Filter holder fasteners hold the filter holder firmly against the body of the CCC. This helps create a good pressure seal between the filter holder and the CCC body. A filter holder access panel doubles as a filter screen. This screen helps hold the filter in place, protects the filter from physical damage, and screens out sputum that may occasionally be expelled in a cough or sneeze, thereby helping to keep the filter clean. In a particular illustrative embodiment of the invention, a Wide open grill space is provided that allows high-rate air flows generated by cough and sneezes to flow freely, with less aerodynamic friction; The grill also holds the filter in place and protects it from physical damage. In a particular illustrative embodiment of the invention, a large filter cross-sectional area is provided. The cross-sectional area of the filter is intentionally made large to accommodate cough/sneeze high flow rates with reduced resistance/pressure drops. In a particular illustrative embodiment of the invention, the thickness of the filter is intentionally made thicker than necessary as an extra layer of redundant safety.

In a particular illustrative embodiment of the invention, a folded back rubber seal is provided. This is basically the reverse of a scuba diving mask design. In a scuba mask the seal edges point outward and the positive pressure is outside the mask. In this design the seal edges point inward, and the positive pressures are inside the mask. This makes for a durable, (internal) positive pressure seal . . . perfect for covering coughs and sneezes.

In a particular illustrative embodiment of the invention, a pliable section of the mask is contoured to exactly match generic face contours of different sizes and shapes. In a particular illustrative embodiment of the invention, the pliable section of the mask is purposefully made of soft flexible material and extended to make the seal pliable enough to conform to individual facial contours and still provide a positive pressure seal. In a particular illustrative embodiment of the invention, a rigid section of the mask the filter holder are made of an inexpensive injection molded plastic.

In a particular illustrative embodiment of the invention, the mask is usable with eyeglasses. The CCC does not extend into areas near the bridge of the nose. This feature makes the CCC more easily used by people who wear vision corrective glasses or sunglasses. In a particular illustrative embodiment of the invention, there are no permanent straps. This method recognizes that when quickly deploying the CCC, straps could swing between the face and seal, causing a potential compromise of the pressure seal. Therefore, no permanent straps are present. The CCC is held in place with a hand and hand pressure seals the CCC against the face.

In a particular illustrative embodiment of the invention, a CCC mask Holder and belt clip are provided. At the heart of the Covid Cough Cleanser is a convenient mask holder and mask holder belt clip are provided. This is an essential part of the plan of having the CCC with you at all times while in public places, while being convenient to access. At certain crowded situations, such as while seating in the middle isle of an airplane, the CCC may be held in hand. Care must be taken, if the CCC, is carried on a lanyard to prevent the lanyard from being accidentally placed between the face and CCC.

In a particular illustrative embodiment of the invention, a CCC hygienic cover face mask receptacle are provided. Integral to the belt holder is a cover that effectively seals access to the potentially contaminated inside surfaces of the CCC. This feature helps to prevent (rare) fomite infections. In a particular illustrative embodiment of the invention, mask holder arms are provided. The belt holder has two arms that hold the CCC in place when not in use. In another particular illustrative embodiment of the invention, a toggle mechanism is provided. The toggle mechanism includes but is not limited to an arm toggle switch closing switch, arm toggle switch opening ramp that provide for simultaneous arm activation. Upon CCC replacement into the Belt Holder, natural seating pressure activates a Toggle Switch that triggers the Mask holder arms to clamp shut, thereby holding the CCC in place. The arm toggle switch opening ramp has arm holding pads. The arm holding pads have a ramp feature. As the CCC is deployed, the ramp gradually separates the arms apart and thereby triggers the Arm Toggle Switch to open the arms fully and hold them there . . . ready to freely allow the CCC to dock back into the Belt Holder upon return. The toggle mechanism provides for simultaneous arm activation. The toggle mechanism is designed to simultaneously open and simultaneously close both mask holder arms. This feature helps keep the CCC centered in place. The CCC provides for left and right-hand use. Aligning the CCC upright on the belt holder allows for left/right symmetry so that the CCC belt holder can be used on the left-hand side by left handers and right-hand side by right handers. The size of the CCC is a carefully chosen compromise between large enough to easily cough and sneeze into, large enough to accommodate the large filter, and yet small enough for ease of handling and portability.

In a particular illustrative embodiment of the invention, a disinfectant wipe dispenser belt holder is provided. Part of the contemplated system is to also carry a small package of disinfectant wipes on a belt holder. This will allow the CCC to be held in one hand while the disinfectant wipe is conveniently accessed with the other hand . . . without having to rummage thru purses or pockets. The disinfectant wipes are used to clean potential contaminants from inside of the CCC. In a particular illustrative embodiment of the invention, the mask receptacle on the mask holder is funnel shaped so that the funnel shape guides the CCC into mating arrangement with the belt holder. In a particular illustrative embodiment of the invention, a grip is provided that allows easier grip of the CCC during deployment and docking. In a particular illustrative embodiment of the invention, Temporary Straps are provided which are available to be used for convenience when the CCC is to be used as a self-protective face mask for an extended period of time. (Mainly useful prior to the CCC going into mandatory universal use.)

Turning now to FIG. 1, in particular illustrative embodiment of the invention 100 a face mask is provided having a pliable second section 1, a face mask seal 2 formed along an edge of the pliable second section, the face mask seal having an inward curved surface, and a rigid first section 4. The pliable second section of the mask and the rigid first section of the face mask are joined together as they are molded together to form a superstructure of the face mask. A filter holder receptacle opening 8 (shown in FIG. 16) is formed as an opening in the rigid front section of the mask. A filter holder 31 front section 5 slides into the filter holder mask receptacle forming an airtight seal between the filter holder mask receptacle opening 8 and the rigid first section 4 of the face mask 100. A plurality of filter air exit ports 3 formed in the filter holder front section allow air to escape from inside the mask after passing through an aerosol filter installed inside of the filter holder. The mask is configured to be held by a person's hand and arm 102, and placed over the person's face 101, and then firmly placed against the face with hand pressure to form a substantially airtight seal between the face mask seal and the persons face. A face mask holder arm ramp 6 and a face mask holder arm ramp toggle surface 7 are formed in the sides of the rigid first section of the face mask configured to engage and mate with a pair left and right mask holder arm ramp pads 13 that are on the ends of the mask holder arms extending from a mask holder 300 shown in FIG. 3. As the face mask 100 is removed from the face mask holder 300, the angled surfaces 25 on the left and right mask holder arm ramp pads 13, slide along the face mask holder arm ramp toggle surfaces 7, and therefore the first and second face mask holder arms 14 and 17 partially swing open, which in turn triggers a compressed spring 33 that is buckled aft, to instead buckle forward, which in turn force the first and second face mask holder arms to snap into a fully open position. The face mask holder arm ramp forms an indention 12 in the interior of the face mask. The face mask holder receptacle sides 20 and face mask holder top 22 are attached to the toggle mechanism housing 32 by attachment member 21.

Figure 2:
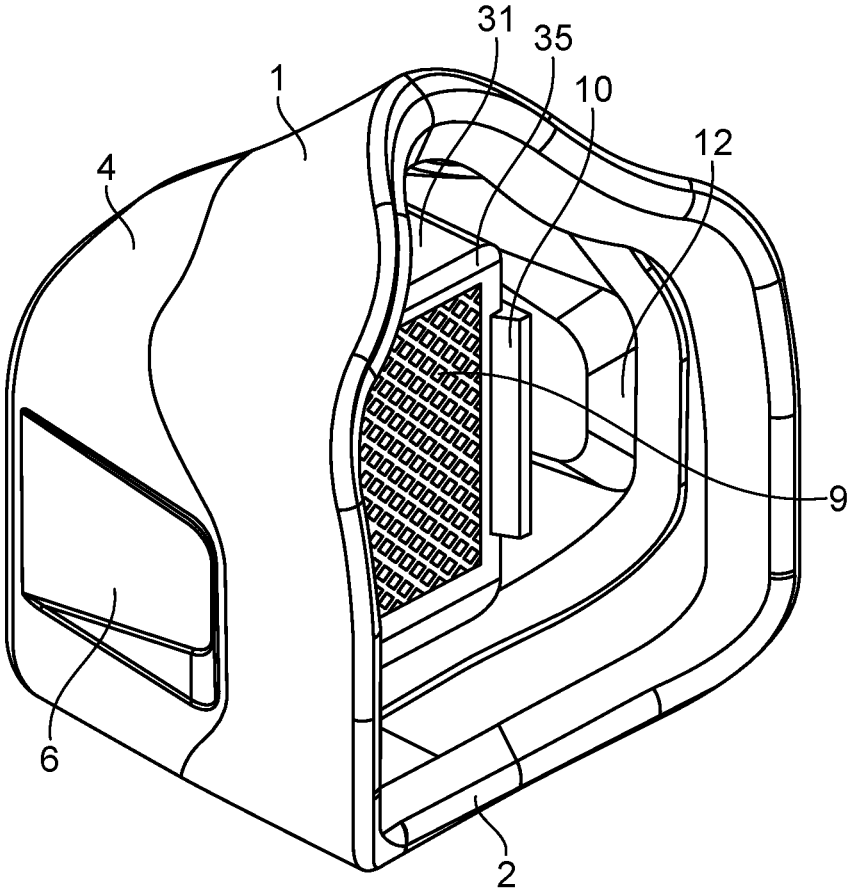
FIG. 2 is a rear three quarter perspective view depiction of a mask in a particular illustrative embodiment of the present invention.

Turning now to FIG. 2, as shown in FIG. 2 as a rear side view of a particular illustrative embodiment of the invention, a filter holder air intake screen 9 with a plurality of porous openings for air flow into a filter holder. The intake grill also blocks larger mucous particles from entering the filter. The open space is 50% of the surface area of the grill in a particular illustrative embodiment of the invention. The filter holder clips into a filter holder clamp 10 to secure the filter holder into rigid first section 4. A rectangular indention 15 formed by the mask holder arm ramp protrudes inwardly into the inside of the mask.

Figure 3:
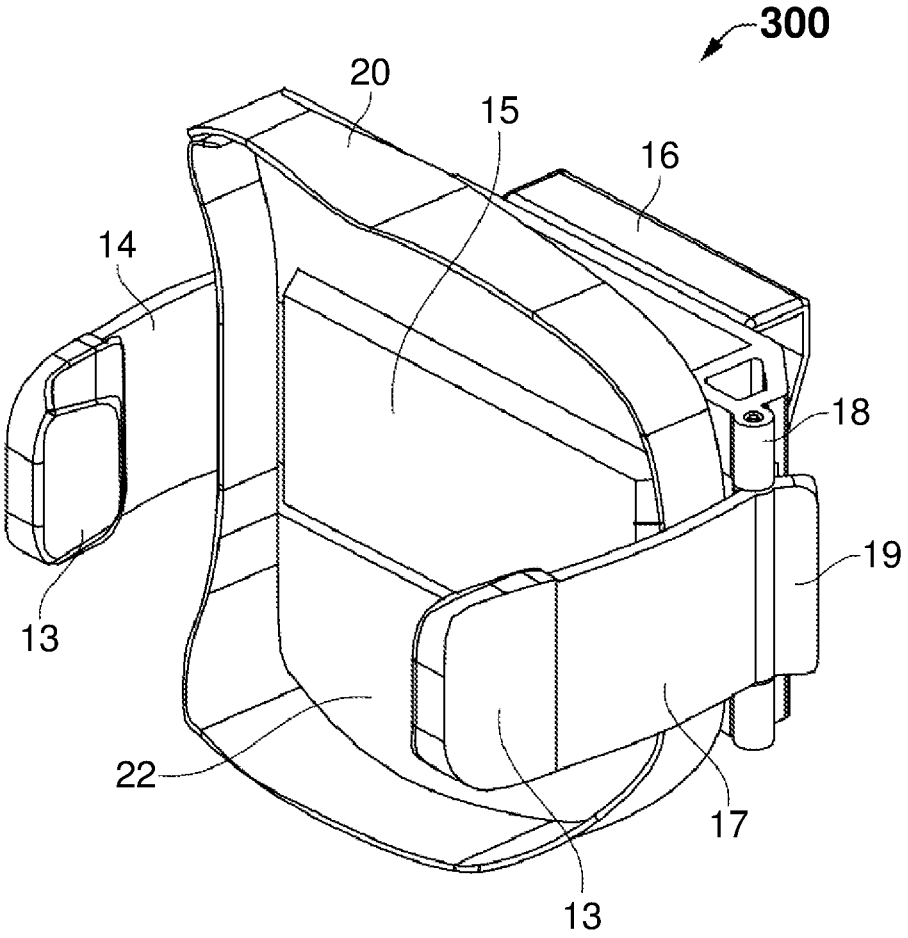
FIG. 3 is a front three quarter view depiction of a mask holder in a particular illustrative embodiment of the present invention.
Figure 4:
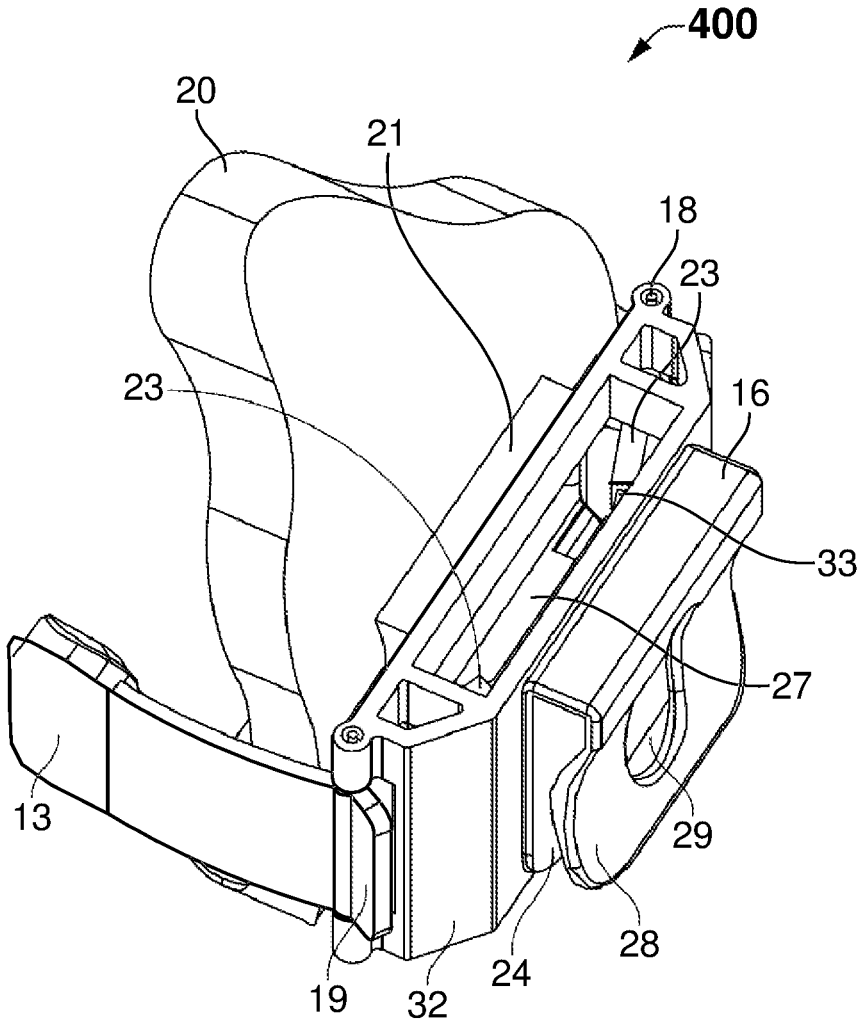
FIG. 4 is a rear three quarter view depiction of a mask holder in a particular illustrative embodiment of the present invention.
Figure 13A:
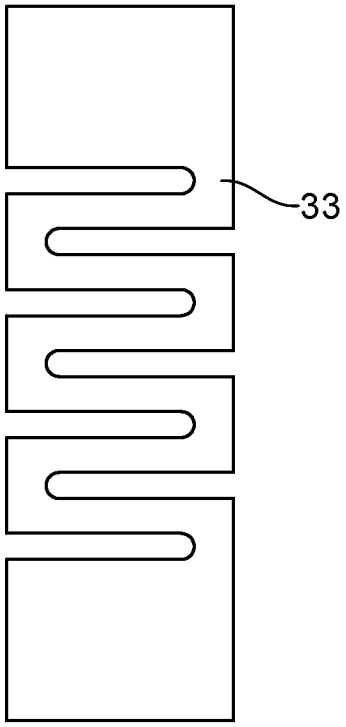
FIG. 13A is a rotated front view depiction of a spring in a particular illustrative embodiment of the present invention.
Figure 13B:
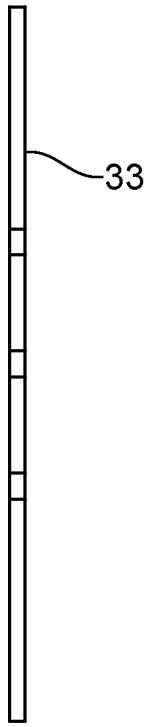
FIG. 13B is a rotated top view depiction of a spring in a particular illustrative embodiment of the present invention.

Turning now to FIG. 3, as shown in FIG. 3 as a front side view of a particular illustrative embodiment of the invention 300, a face mask holder receptacle sides 20 and face mask holder top 22 for receiving and holding the face mask 100 is depicted. A first face mask holder arm 17 and a second face mask holder arm 14 are attached to the toggle mechanism housing by a pair of hinges 18. The face mask holder receptacle top 22 is attached to the toggle mechanism housing 32 with four screws. A face mask holder arm outer tab 19 is formed on the hinged end of the face mask holder arms, to limit outward rotation of the mask holder arms outward into the open position when the mask is removed and disengaged from the mask holder receptacle sides 20 face mask holder receptacle top 22. A face mask holder arm pad 13 is formed on the non-hinged ends of the first and second mask holder arms. A face mask holder top 22 of the face mask holder receptacle has a rectangular indention 15 formed inside of the mask holder receptacle. The rectangular indention 15 is a hollow protrusion that allows room for the spring 33 to bend forward during rotation of the first and second mask holder arms during removal of the face mask out of the face mask holder receptacle. When the face mask holder arms are opened the spring bends into the hollow protrusion 15. In a particular illustrative embodiment of the invention the face mask holder receptacle sides 20 overlap the face mask seal 2 when the face mask seal is pressed against the interior surface of the face mask holder receptable. In a particular illustrative embodiment the face mask holder receptacle sides 20 are flared out and away from the face mask holder receptacle top 22 to help guide the face mask into the face mask holder receptacle. The face mask holder receptacle sides 20 and top 22 act as a lid for the face mask when the face mask is inserted into the face mask holder, so that potentially infectious material inside of the face mask is not accessible to others. The face mask holder receptacle sides 20 overlap the face mask seal when the face mask is inserted fully into the face mask holder receptacle sides 20 and top 22. A belt clip having a belt clip top 16 is fixably attached to the toggle mechanism housing 32 (as shown in FIG. 4) is configured for attaching the belt clip and mask holder receptacle to a person's belt for carriage of the face mask and face mask holder. In a particular illustrative embodiment of the invention, the spring 33 is a flat spring as shown in FIGS. 13A and 13B.

Turning now to FIG. 4, as shown in FIG. 4 as a rear side view of a particular illustrative embodiment of the invention 400 of the mask holder receptacle is attached to a toggle mechanism housing 32. The toggle mechanism is spring loaded and used to lock the mask holder arms in either an open or closed position. The toggle mechanism does this by passing through a spring loaded "toggle" point where any force into the toggle mechanism causes the toggle mechanism to maintain its position, either open or closed. When the mask pressed into the mask holder the toggle mechanism forces the mask holder arms to be toggled closed to keep the mask firmly in the mask holder and held in place by the mask holder arms, forming a physical barrier between the potentially contaminated inside of the mask and the general public. For example, when a person coughs openly on a public bus, the bus is recalled and decontaminated and a replacement bus is provided. One must understand how infection occurs before one is able to prevent infection. The inventor believes that Covid-19 is not spread by talking and breathing but rather by coughing and sneezing which the present invention substantially addresses by substantially containing contaminated particles generated by coughing and sneezing. When the mask is removed from the mask holder, the toggle mechanism maintains the mask holder arms in the open position and ready to receive the mask for reattachment to the mask holder after removal. A pair of spring retention bars 23 hold the toggle spring 33 and maintain force on the mask holder arms. Face mask holder arm outer tab 19 limits the rotation of the mask holder arms outward away from the mask in the open position. The belt clip holder has a belt clip receptacle 28 for sliding over a person's belt to hold the mask holder and the mask when installed in the belt holder. The belt clip is attached to the toggle mechanism housing by belt clip attachment plate 24. Spring relief space 27 allows the spring 33 room to bend when the toggle mechanism rotates the mask holder arms. Spring relief space 27 forms indention 15 inside of the face mask receptacle. Belt clip front surface 29 attached the belt clip to the toggle mechanism housing 32. The toggle mechanism assumes one of two stable positions under the compressive forces exerted on the spring by the toggle mechanism toggle spring receptacle slots 26. A first stable position when the mask holder arms are fully opened and a second stable position when the mask holder arms are in the fully closed position and resting on the face mask holder ramps when the face mask is inserted into the face mask holder. The face mask receptacle serves as a lid or covering for the inside of the face mask to avoid exposure from the inside of the mask to others so that the potentially contaminated inside surfaces of the mask after a cough is not exposed to the public.

Figure 5:
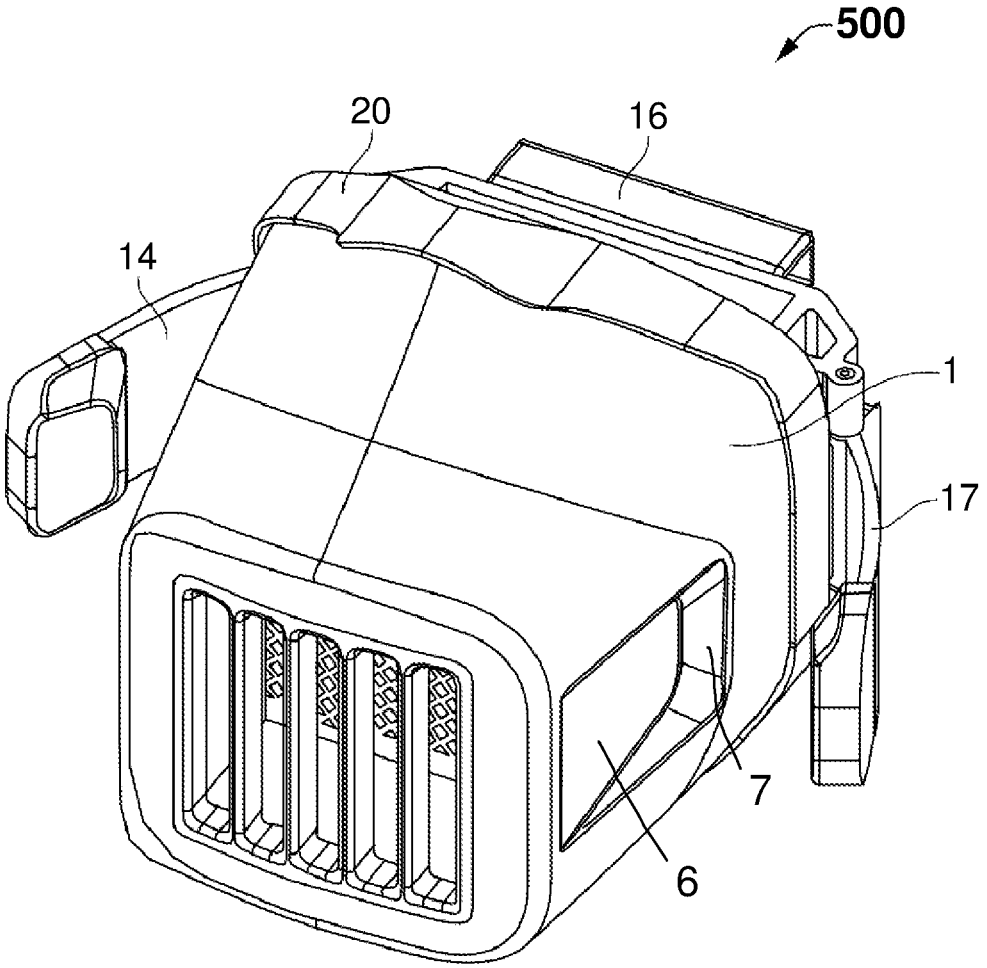
FIG. 5 is a front three quarter view depiction of a mask that is partially inserted into a mask holder with open mask holder arms in a particular illustrative embodiment of the present invention.

Turning now to FIG. 5, as shown in FIG. 5 as a front view of a particular illustrative embodiment of the invention 500, the mask is partially inserted into the mask holder with the mask holder arms held in the open position by the toggle mechanism.

Figure 6:
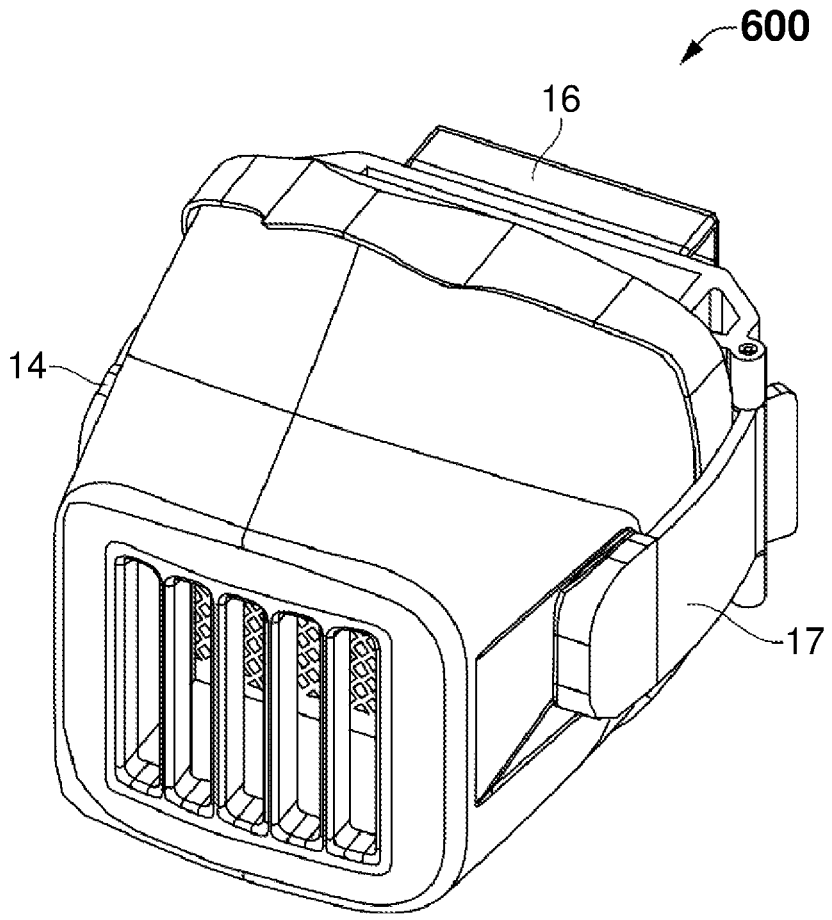
FIG. 6 is a front three quarter view depiction of a mask fully inserted to a mask holder in a particular illustrative embodiment of the present invention.

Turning now to FIG. 6, as shown in FIG. 6 as a front view of a particular illustrative embodiment of the invention 600, the mask is inserted into the mask holder with the mask holder arms held in the closed position by the toggle mechanism. The toggle mechanism forces the arms to the closed position when the mask is fully inserted into the mask holder.

Figure 7:
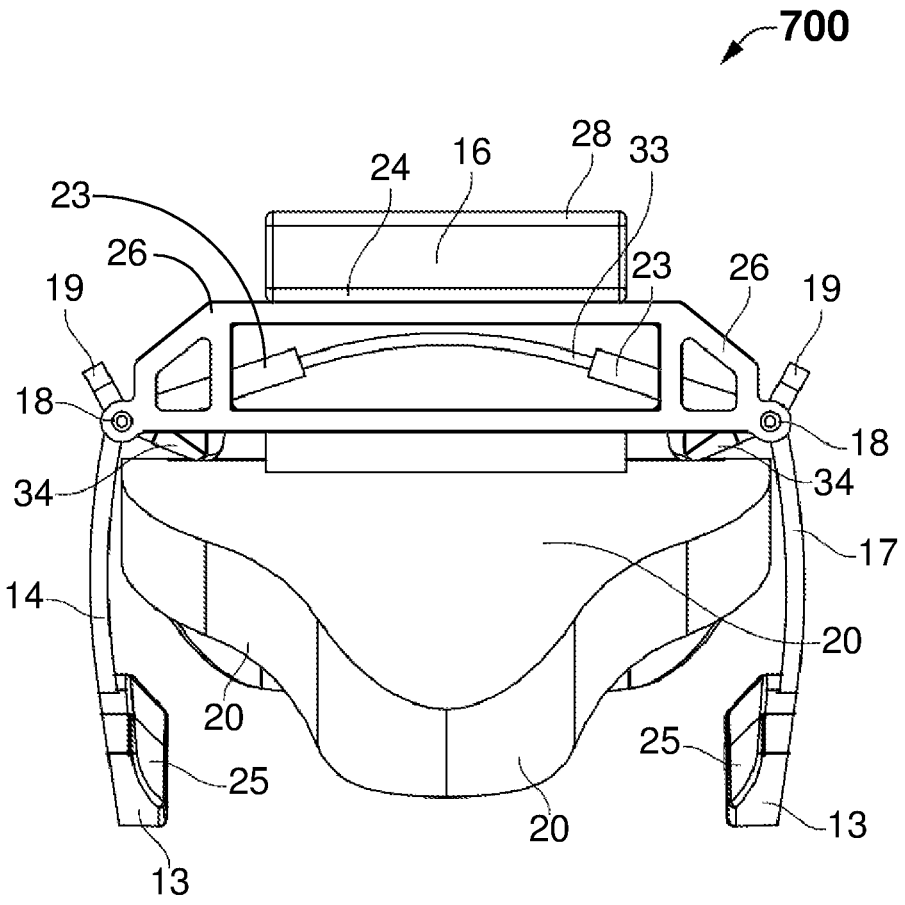
FIG. 7 is a top view depiction of a mask holder in a particular illustrative embodiment of the present invention.

Turning now to FIG. 7, as shown in FIG. 7 as a top view of a particular illustrative embodiment of the invention 700, the mask is inserted into the mask holder with the mask holder arms held in the open position by the toggle mechanism spring 33. Mask arms toggle tabs 34 are forced backward by the mask face seal when the mask is inserted into the mask holder. Face mask holder arm pads 13 have a beveled edge 25 that mates with and slides over the mask holder arm ramp toggle surface 7.

Figure 8:
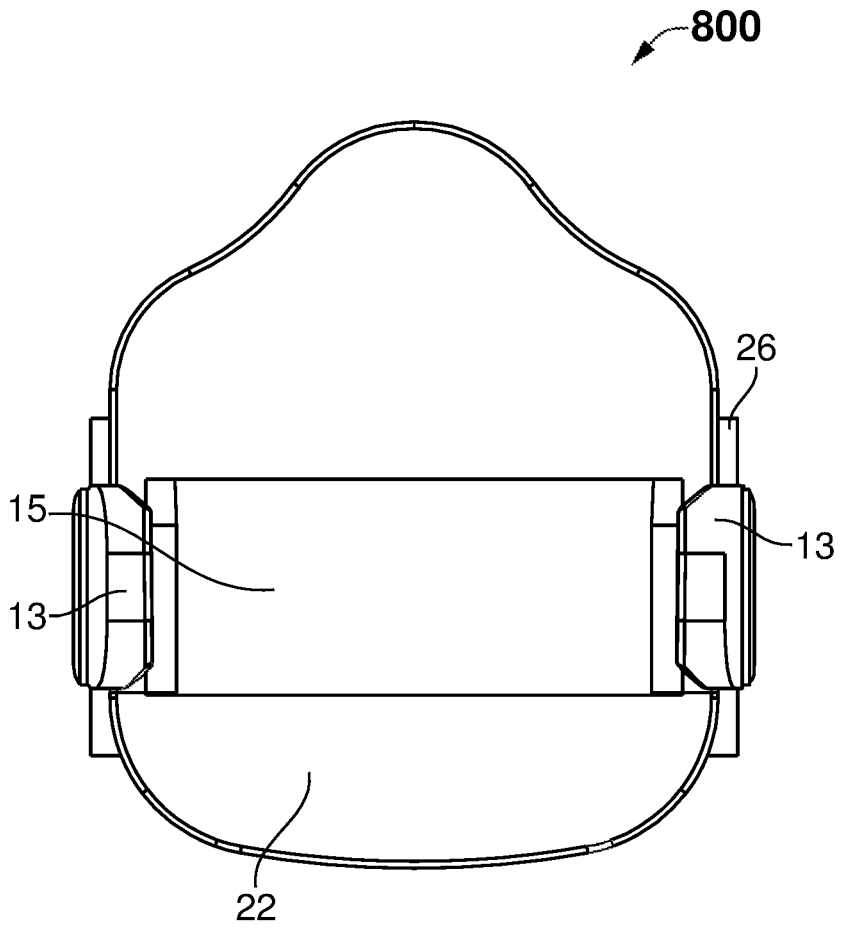
FIG. 8 is a front view depiction of a mask holder in a particular illustrative embodiment of the present invention.
Figure 9:
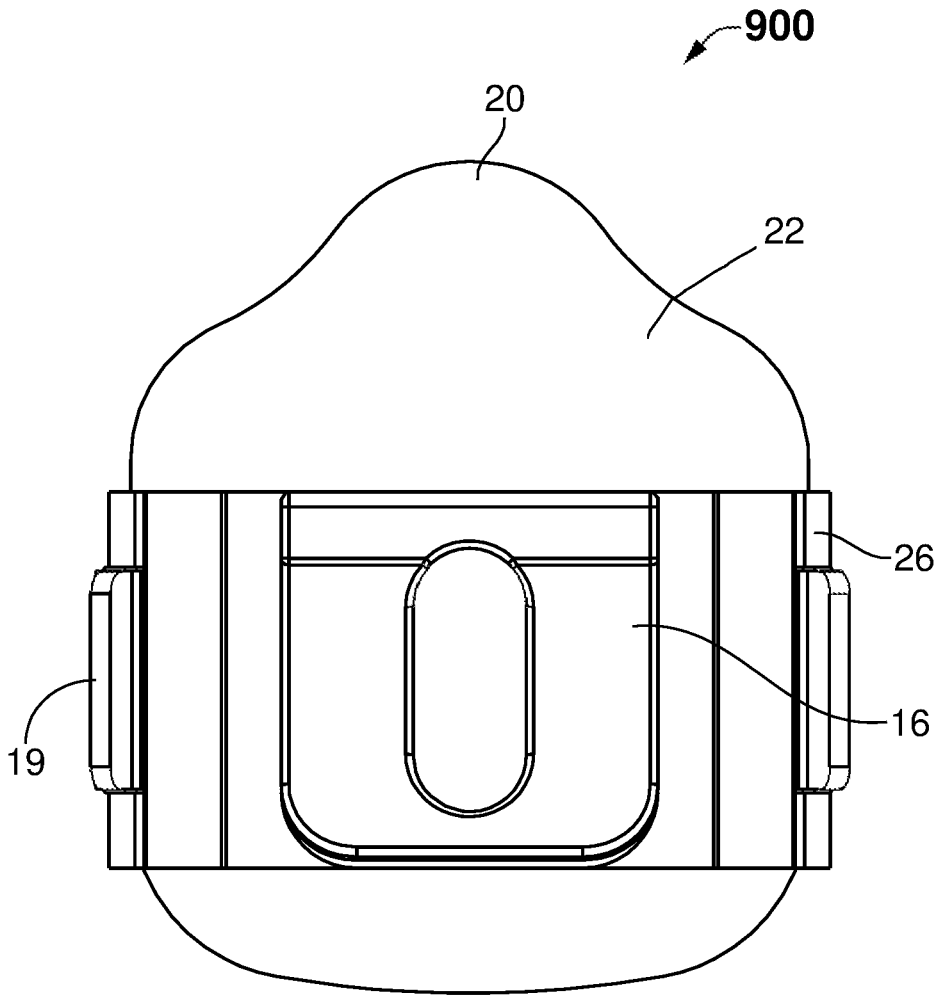
FIG. 9 is a rear view depiction of a mask holder and attached belt clip in a particular illustrative embodiment of the present invention.
Figure 10:
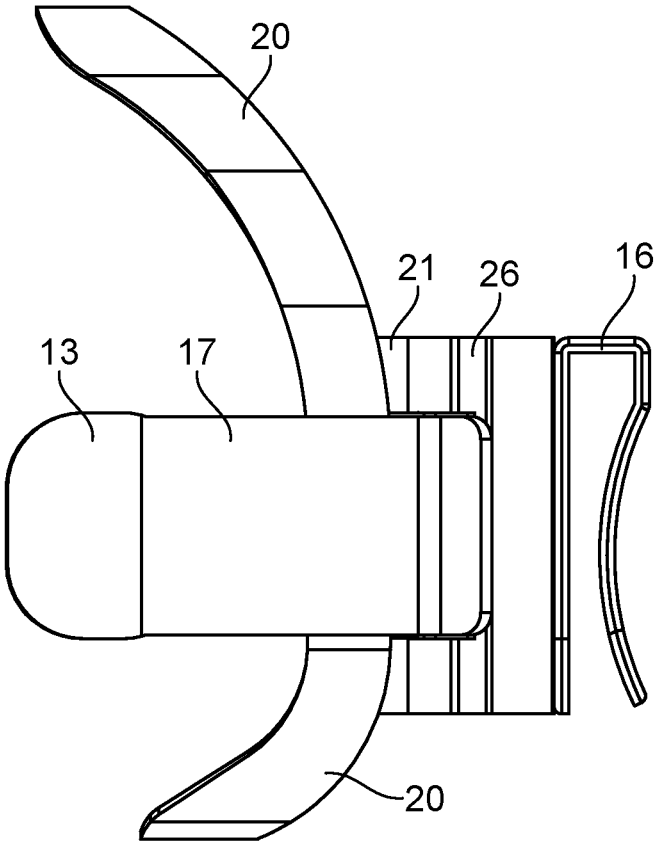
FIG. 10 is a side view depiction of a mask holder and attached belt clip in a particular illustrative embodiment of the present invention.

Turning now to FIG. 8, as shown in FIG. 8 as a front view of a particular illustrative embodiment of the invention 800 is depicted of the mask holder. Turning now to FIG. 9, as shown in FIG. 9 as a rear view of a particular illustrative embodiment of the invention 900 is depicted of the mask holder attached to the belt clip. Turning now to FIG. 10, as shown in FIG. 9 as a side view of a particular illustrative embodiment of the invention 900 is depicted of the mask holder attached to the belt clip.

Figure 11:
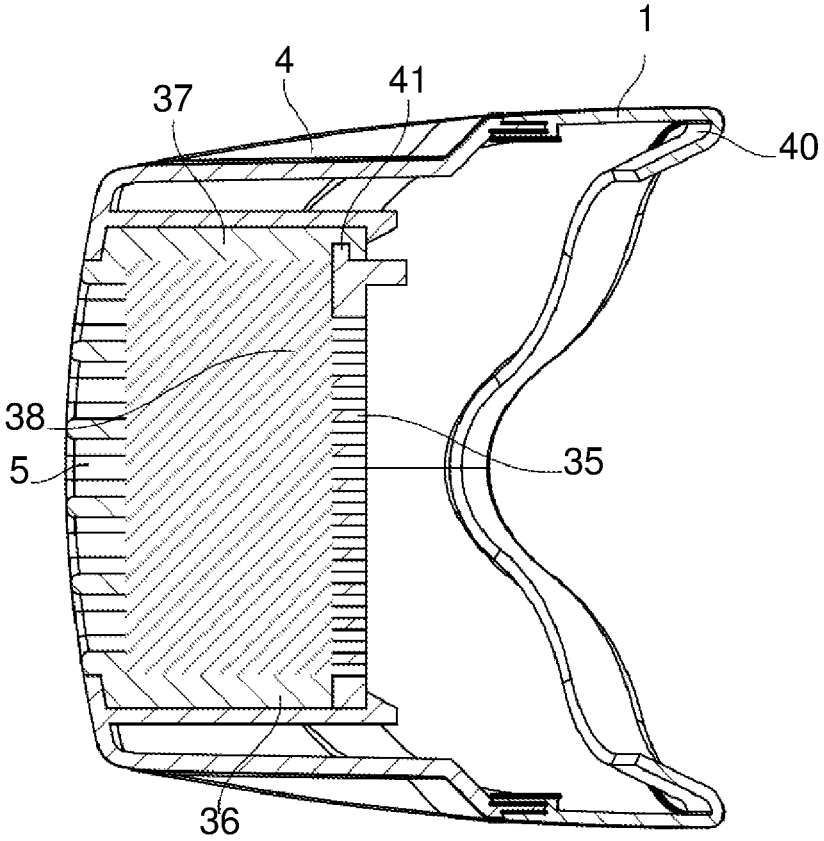
FIG. 11 is a top view depiction of a cross section of a mask in a particular illustrative embodiment of the present invention.

Turning now to FIG. 11, in a particular embodiment of the invention, as shown in a top cross sectional view of the mask, filter holder lid 35 has tabs 41 on each side of the lid that slide into slots formed in two side sections 36 and 37 of the filter holder. The filter holder door is slide out of the filter holder to allow access to an interior of the filter holder to insert or remove an aerosol filter in the filter holder. The filter holder allows a cough or sneeze to pass through the aerosol filter and exit the mask through the air filter exit ports 3 which in a particular illustrative embodiment, vertical oval shaped apertures in the filter holder front 5. The edge 40 of the pliable second section 1 of the mask that covers the persons face is folded inward so that when a person presses the mask to their face the mask forms a better inner pressure seal than a mask having an edge that folds outward.

Figure 12:
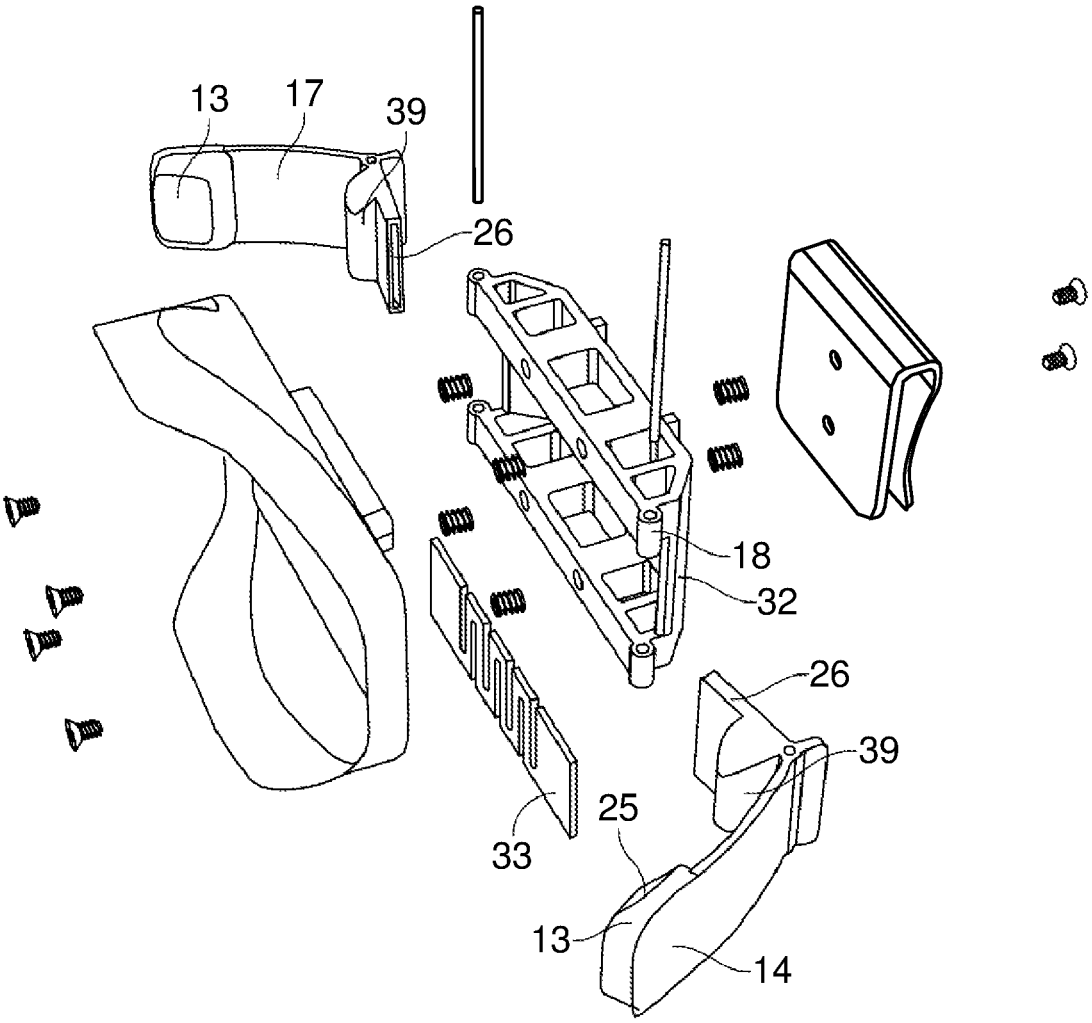
FIG. 12 is a top three quarter view depiction, of an exploded view, of a mask holder, belt clip and toggle mechanism in a particular illustrative embodiment of the present invention.

Turning now to FIG. 12, FIG. 12 is an exploded view of a particular illustrative embodiment of the invention. As the mask is fully pressed into the mask holder, a force is applied to the toggle surface 39 and this in turn causes the face mask holder arms to partially close and this causes the compressed spring that is buckled forward to instead buckle aft which then forces the arms to snap closed to the fully closed position. As shown in FIG. 12, toggle surface 25 is provided on each mask holder arm pad to cause the toggle mechanism to rotate the mask holder arms open and disengage from the face mask as the toggle surface 25 slides over mask holder ramp arm toggle surface 7 and stays open or closed under the influence the toggle mechanism spring 33.

Toggle mechanism spring 33 fits into a toggle spring receptacle slot 26 formed on the hinged end of the face mask holder arm. The face mask holder arm pads 13 are beveled to the same angle as the face mask holder ramp arm toggle surface 7 so that the mask is easily slide in and out of the mask holder 300.

Turning now to FIGS. 13A and 13B, FIG. 13A and FIG. 13B are a front and side view respectively of the toggle mechanism spring 33 in a particular illustrative embodiment of the invention.

Figure 14:
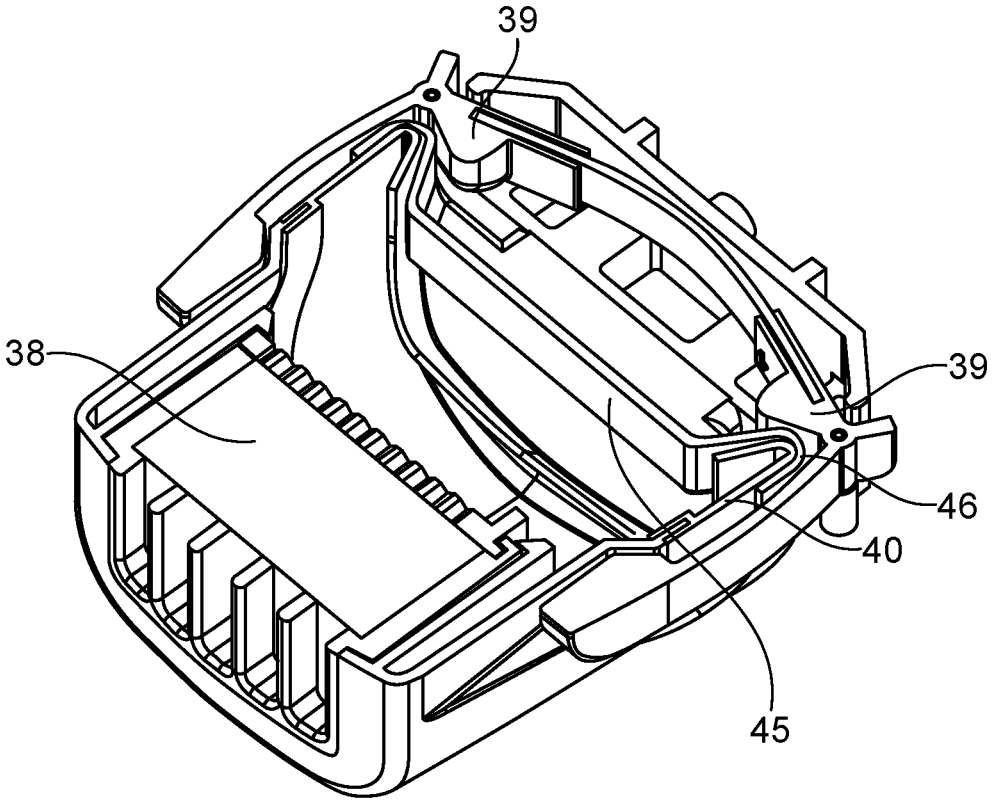
FIG. 14 is a three quarter top view depiction of a cross section of a mask fully inserted into a mask holder in a particular illustrative embodiment of the present invention.

Turning now to FIG. 14, FIG. 14 is top view of a cross section of the face mask fully engaged in the face mask holder showing the aerosol filter 38 installed in the filter holder. Mask receptable member 45 has a face mask seal engagement member 46 which is curved and shaped like the face mask seal to engage the face mask seal folded section 40 formed by the face mask seal folded section. When the mask is pushed into the mask holder so that mask seal presses on the mask seal engagement member that engages an inner section of the arm toggle member to overcome the force of the spring and rotates the mask holder arms inward to engage the mask holder arm ramps to hold the mask on the mask holder.

Figure 15:
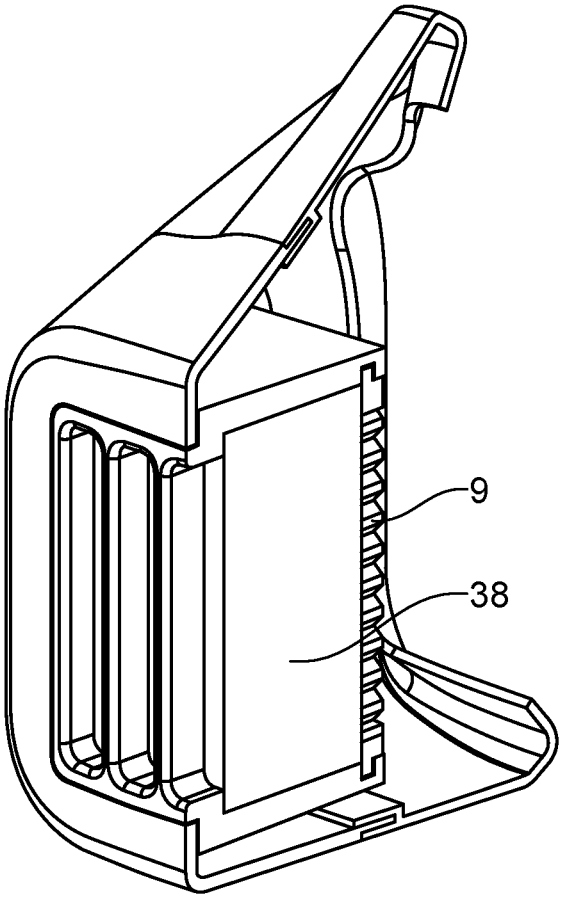
FIG. 15 is a three quarter side view depiction of a cross section of a mask in a particular illustrative embodiment of the present invention.

Turning now to FIG. 15, as shown in FIG. 15, in a particular illustrative embodiment of the invention the aerosol filter is installed in the filter holder.

Figure 16:
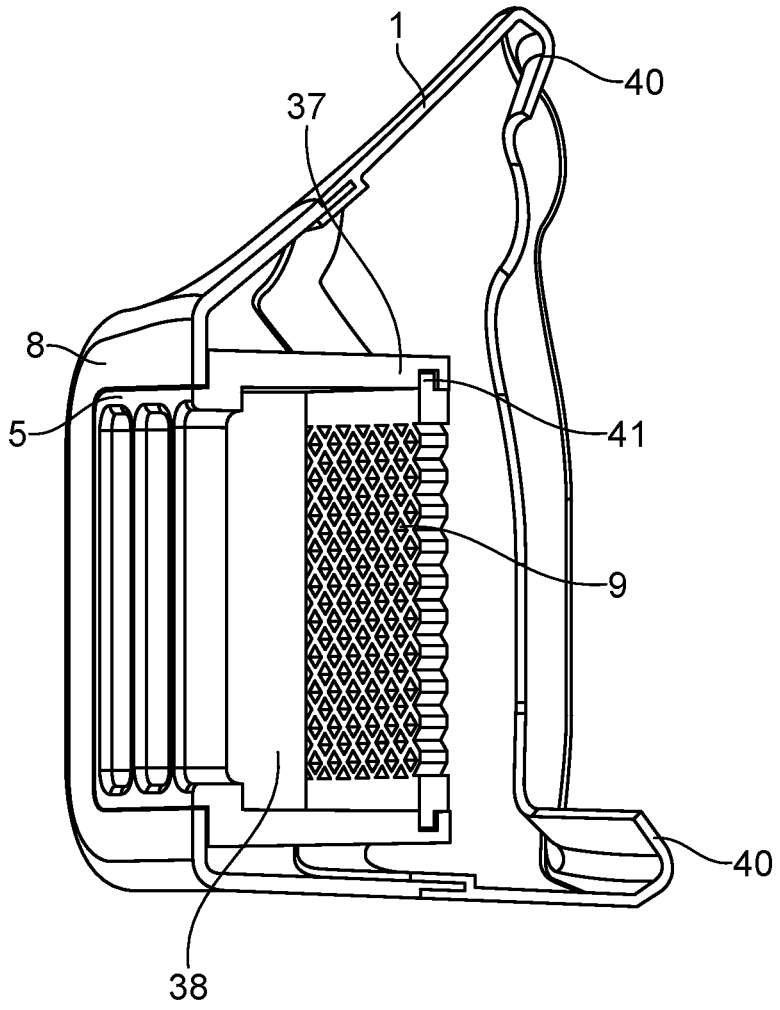
FIG. 16 is a side view depiction of a cross section of a mask in a particular illustrative embodiment of the present invention.

Turing now to FIG. 16, as shown in FIG. 16, in a particular illustrative embodiment of the invention the aerosol filter is installed in the filter holder.

Figure 17:
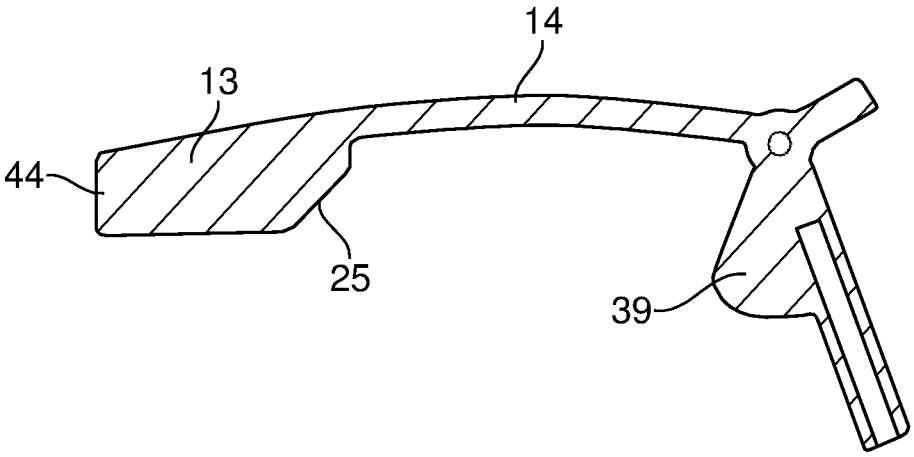
FIG. 17 is a top view depiction of a cross section of a belt holder arm in a particular illustrative embodiment of the present invention.

Turing now to FIG. 17, as shown in FIG. 1, a particular illustrative embodiment of the invention the mask holder arm is depicted. Face mask holder arm tip 44 is formed on face mask holder arm.

In particular illustrative embodiment of the invention, an apparatus is disclosed for containing a cough aerosol, the apparatus including but not limited to a face mask having a rigid first section configured to hold a filter and a pliable second section configured to fit on a person's face; a face mask seal formed on an edge of the pliable second section of the face mask;

a curved surface on the face mask seal configured to fold inward to form a seal on the person's face when pressed on the person's face; a filter holder removably attached inside of the rigid first section of the face mask; a filter, wherein the filter holder is configured to contain the aerosol filter; a first face mask holder arm ramp and a second face mask holder arm ramp formed on the rigid first section of the face mask; a first toggle surface formed on a first end of first face mask holder arm ramp and second toggle surface formed on a first end of second face mask holder arm ramp; a face mask holder configured to hold the face mask; a first and second face mask holder arm rotationally attached to the face mask holder and configured to hold the face mask on the face mask holder; a first face mask holder arm having a first end hinged to the face mask holder and a second face mask holder arm having a first end hinged to the face mask holder; and a toggle mechanism on the face mask holder configured to rotate a first and second face mask holder arm inward to engage a first and second mask holder arm ramp on the face mask when the face mask is inserted into the face mask holder and rotate a second end of the first face mask holder arm and a second end of the second face mask holder arm outward and disengage a first and second face mask holder arm ramp toggle surface on the face mask when the face mask is removed from the face mask holder.

In another illustrative embodiment of the apparatus, the apparatus further includes but is not limited to a face mask seal engagement member on the toggle mechanism configured to engage the face mask seal and cause the toggle mechanism to rotate a first and second face mask holder arm inward to engage the first and second face mask holder arm ramp and hold the face mask in the face mask holder.

In another illustrative embodiment of the apparatus, the apparatus further includes but is not limited to a spring inside of the toggle mechanism attached between a first hinged end of the first face mask holder arm and a first hinged end of the second face mask holder arm, wherein the spring causes the second end of the first and second face mask holder arm to rotate outward and disengage from the first and second face mask holder arm ramp on the face mask when the face mask is removed from the face mask holder.

In another illustrative embodiment of the apparatus, the apparatus further includes but is not limited to a first face mask holder arm tab formed on a first hinged end of the first face mask holder arm and a second face mask holder arm tab formed on a first hinged end of the second face mask holder arm to limit outward rotation of the second end of the first and second face mask holder arm.

In another illustrative embodiment of the apparatus, the apparatus further includes but is not limited to a toggle surface formed on the first hinged end of the first and second face mask holder arm configured to cause the second end of first and second mask holder arms to rotate inward when the face mask seal in inserted into the face mask seal engagement member.

In another illustrative embodiment of the apparatus, the apparatus further includes but is not limited to a slot formed in the first end of the first and second mask holder arms configured to attach the spring between the first and second mask holder arms.

In another illustrative embodiment of the apparatus, the apparatus further includes but is not limited to a belt clip attached to the face mask holder configured to attach the face mask holder to a person's belt for carrying the face mask on a person's belt. In another illustrative embodiment of the apparatus, the face mask holder is configured with sides that overlap the face mask seal when the face mask is fully inserted into the face mask holder.

In another illustrative embodiment of the apparatus, the apparatus further includes but is not limited to a filter holder receptacle opening formed in the rigid first section of the face mask holder configured to form an airtight seal between the filter holder receptacle opening and a filter holder front section when the filter holder front section is inserted into the filter holder receptacle opening. In another illustrative embodiment of the apparatus, the spring is a flat spring. In another illustrative embodiment of the apparatus, the filter is a high air flow rate filter.

In another illustrative embodiment of the invention a method is disclosed for containing a cough aerosol, the method including but not limited to sliding a pair of face mask holder arm pads over a toggle surface on a face mask holder arm ramp; triggering a toggle mechanism by the sliding of the arm pads over the toggle surface; rotating a pair of mask holder arms on a face mask holder, outward and away from the pair of face mask holder ramps on a face mask using a toggle mechanism to release the face from the face mask holder; sealing the face mask to a person's face with an inward fold on a face mask seal when the person holds the face mask to their face; receiving a cough aerosol in the face mask from a person's face while the face mask is held to the person's face; and filtering the cough aerosol in the face mask through a high flow rate filter in the face mask.

In another illustrative embodiment of the method, the method further includes but is not limited to engaging the face mask with the toggle mechanism when the face mask is inserted into the face mask holder; and rotating via the toggle mechanism the pair of mask holder arms, inward and toward a pair of face mask holder ramps on the face mask using the toggle mechanism to secure the face in the face mask holder.

The specification and drawings are, accordingly, to be regarded in an illustrative rather than a restrictive sense. It will be evident that additions, subtractions, deletions, and other modifications and changes may be made thereunto without departing from the broader spirit and scope of the inventions as set forth in the claims set forth below. Accordingly, the inventions are therefore to be limited only by the scope of the appended claims.

The invention claimed is:

1. An apparatus for containing a cough aerosol, the apparatus comprising:

a face mask having a rigid first section configured to hold a filter and a pliable second section configured to fit on a person's face;

a face mask seal formed on an edge of the pliable second section of the face mask;

a curved surface on the face mask seal configured to fold inward to form a seal on the person's face when pressed on the person's face;

a filter holder removably attached inside of the rigid first section of the face mask, wherein the filter holder is configured to contain the filter;

a first face mask holder arm ramp and a second face mask holder arm ramp formed on the rigid first section of the face mask;

a first toggle surface formed on a first end of the first face mask holder arm ramp and a second toggle surface formed on a first end of the second face mask holder arm ramp;

a face mask holder configured to hold the face mask;

a first face mask holder arm and a second face mask holder arm rotationally attached to the face mask holder and configured to hold the face mask on the face mask holder;

the first face mask holder arm having a first end hinged to the face mask holder and the second face mask holder arm having a first end hinged to the face mask holder; and a toggle mechanism on the face mask holder configured to rotate a first and second face mask holder arm inward to engage a first and second mask holder arm ramp on the face mask when the face mask is inserted into the face mask holder and rotate a second end of the first face mask holder arm and a second end of the second face mask holder arm outward and disengage a first and second face mask holder arm ramp toggle surface on the face mask when the face mask is removed from the face mask holder.

2. The apparatus of claim 1, the apparatus further comprising: a face mask seal engagement member on the toggle mechanism configured to engage the face mask seal and cause the toggle mechanism to rotate the first face mask holder arm and the second face mask holder arm inward to engage the first face mask holder arm ramp and the second face mask holder arm ramp and hold the face mask in the face mask holder.

3. The apparatus of claim 2, the apparatus further comprising: the first face mask holder arm having a first hinged end, the second face mask holder arm having a first hinged end, a spring inside of the toggle mechanism attached between the first hinged end of the first face mask holder arm and the first hinged end of the second face mask holder arm, wherein the spring causes the second end of the first face mask holder arm and the second end of the second face mask holder arm to rotate outward and disengage from the first face mask holder arm ramp and the second face mask holder arm ramp on the face mask when the face mask is removed from the face mask holder.

4. The apparatus of claim 3, the apparatus further comprising: a first face mask holder arm tab formed on the first hinged end of the first face mask holder arm and a second face mask holder arm tab formed on the first hinged end of the second face mask holder arm to limit outward rotation of the second end of the first and second face mask holder arm.

5. The apparatus of claim 4, the apparatus further comprising: a toggle surface formed on the first hinged end of the first and second face mask holder arm configured to cause the second end of first and second mask holder arms to rotate inward when the face mask seal is in inserted into the face mask seal engagement member.

6. The apparatus of claim 5, the apparatus further comprising: a slot formed in the first hinged ends of the first and second mask holder arms configured to attach the spring between the first and second mask holder arms.

7. The apparatus of claim 6, the apparatus further comprising:

a belt clip attached to the face mask holder configured to attach the face mask holder to the person's belt for carrying the face mask on a person's belt.

8. The apparatus of claim 7, wherein face mask holder is configured with sides that overlap the face mask seal when the face mask is fully inserted into the face mask holder.

9. The apparatus of claim 8, the apparatus further comprising:

a filter holder receptacle opening formed in the rigid first section of the face mask holder configured to form an airtight seal between the filter holder receptacle opening and a filter holder front section when the filter holder front section is inserted into the filter holder receptacle opening.

10. The apparatus of claim 9, wherein the spring is a flat spring.

11. The apparatus of claim 10, wherein the filter is a high air flow rate filter.

12. A method for containing a cough aerosol, the method comprising:

sliding a first face mask holder arm pad over a first toggle surface on a first face mask holder arm ramp and a second face mask holder arm ramp over a second toggle surface on a second face mask holder arm ramp;

triggering a first toggle mechanism by the sliding of the first face mask holder arm pad over the first toggle surface and triggering a second toggle mechanism by sliding of the second face mask holder arm pad over the second toggle surface;

rotating a pair of face mask holder arms on a face mask holder, outward and away from the pair of face mask holder ramps on a face mask using the first and second toggle mechanisms to release the face mask from the face mask holder;

sealing the face mask to a person's face with an inward fold on a face mask seal when the person holds the face mask to the person's face;

receiving the cough aerosol in the face mask from the person's face while the face mask is held to the person's face; and filtering the cough aerosol in the face mask through a high flow rate filter in the face mask.

13. The method of claim 12, the method further comprising:

engaging the face mask with the first and second toggle mechanisms when the face mask is inserted into the face mask holder;

rotating, via the first and second toggle mechanisms the pair of face mask holder arms, inward and toward the first and second face mask holder arm ramps on the face mask using the first and second toggle mechanisms to secure the face in the face mask holder.

14. The method of claim 13, the method further comprising:

covering the face mask interior surface with a face mask receptacle holder side and face mask receptacle holder top to keep potentially infectious particles inside of the face mask from being accessed when the face mask is fully inserted into the face mask holder.

15. The method of claim 14, the method further comprising:

removing a filter holder from inside the face mask;

sliding a filter holder lid off a first end of the filter holder;

removing the high flow rate filter from the filter holder; and replacing the high flow rate filter in the filter holder.

* * * * *